US012741732B2

(12) United States Patent
Perdomo Tornbaum et al.

(10) Patent No.: US 12,741,732 B2
(45) Date of Patent: Sep. 22, 2026

(54) MARINE PROPULSION SYSTEM AND METHOD WITH SINGLE REAR DRIVE AND LATERAL MARINE DRIVE

(71) Applicant: Brunswick Corporation, Mettawa, IL (US)

(72) Inventors: Andres Perdomo Tornbaum, Neenah, WI (US); Andrew S. McAuliffe, Edgewater, FL (US); Kyle F. Karnick, Fond du Lac, WI (US); Ryan M. Trost, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 58 days.

(21) Appl. No.: 18/663,618

(22) Filed: May 14, 2024

(65) Prior Publication Data

US 2025/0353586 A1 Nov. 20, 2025

(51) Int. Cl.
*B63H 25/42* (2006.01)
*B63H 20/00* (2006.01)
(Continued)

(52) U.S. Cl.
CPC ..... *B63H 25/42* (2013.01); *B63H 20/12* (2013.01); *B63H 25/04* (2013.01); *B63H 2020/003* (2013.01)

(58) Field of Classification Search
CPC ..... B63H 25/42; B63H 20/12; B63H 25/04; B63H 2020/003
See application file for complete search history.

(56) References Cited

U.S. PATENT DOCUMENTS 6,234,853 B1 5/2001 Lanyi et al.
6,402,577 B1 6/2002 Treinen et al.
(Continued)

FOREIGN PATENT DOCUMENTS

EP 0816962 1/1998
EP 4309997 A1 1/2024
(Continued)

OTHER PUBLICATIONS

"Joystick Driving: Experience A New and Intuitive Way of Boat Driving," Volvo Penta, Goteborg, Sweden, Mar. 2017, 2 pages.
(Continued)

*Primary Examiner* — Scott A Browne
*Assistant Examiner* — Jason Nguyen
(74) *Attorney, Agent, or Firm* — Andrus Intellectual Property Law, LLP

(57) ABSTRACT

A marine propulsion system for a marine vessel includes one steerable rear marine drive positioned along a centerline of the marine vessel and a lateral marine drive positioned at a bow region of the vessel. The rear marine drive is configured to generate forward and reverse thrusts, wherein the rear marine drive is steerable about a vertical steering axis to a range of steering angles, and the lateral marine drive is configured to generate lateral thrust on the marine vessel. A user input device is operable by a user to provide a sway demand input commanding sway movement of the marine vessel, and a control system configured to automatically control steering and thrust of the one rear marine drive and thrust of the lateral marine drive based on the sway demand input to generate the sway movement commanded by the user.

19 Claims, 9 Drawing Sheets

(51) Int. Cl.
*B63H 20/12* (2006.01)
*B63H 25/04* (2006.01)

(56) References Cited

U.S. PATENT DOCUMENTS

| | | | | |
|---|---|---|---|---|
| 6,848,382 | B1 | 2/2005 | Bekker | |
| 7,036,445 | B2 | 5/2006 | Kaufmann et al. | |
| 7,398,742 | B1 | 7/2008 | Gonring | |
| 7,467,595 | B1 | 12/2008 | Lanyi et al. | |
| 8,965,606 | B2 | 2/2015 | Mizutani | |
| 9,039,468 | B1 * | 5/2015 | Arbuckle | B63H 25/04 440/79 |
| 9,126,667 | B2 * | 9/2015 | Mizutani | B63H 21/213 |
| 9,440,724 | B2 | 9/2016 | Suzuki et al. | |
| 9,616,971 | B2 | 4/2017 | Gai | |
| 9,963,214 | B2 | 5/2018 | Watanabe et al. | |
| 9,988,134 | B1 | 6/2018 | Gable et al. | |
| 10,011,342 | B2 | 7/2018 | Gai et al. | |
| 10,259,555 | B2 | 4/2019 | Ward et al. | |
| 10,926,855 | B2 | 2/2021 | Derginer et al. | |
| 10,953,973 | B2 | 3/2021 | Hayashi et al. | |
| 11,009,880 | B2 | 5/2021 | Miller et al. | |
| 11,091,243 | B1 | 8/2021 | Gable et al. | |
| 11,433,983 | B1 | 9/2022 | Gable | |
| 11,572,146 | B2 | 2/2023 | Kraus et al. | |
| 12,134,454 | B1 * | 11/2024 | Derginer | G05D 1/0206 |
| 12,405,610 | B1 * | 9/2025 | Naik | B63H 20/12 |
| 2007/0089660 | A1 * | 4/2007 | Bradley | B63H 21/22 114/144 A |
| 2019/0202541 | A1 | 7/2019 | Pettersson et al. | |
| 2020/0269962 | A1 | 8/2020 | Gai et al. | |
| 2021/0061426 | A1 | 3/2021 | Gai et al. | |
| 2021/0286362 | A1 | 9/2021 | Malouf et al. | |
| 2022/0194542 | A1 | 6/2022 | Kirchoff et al. | |
| 2025/0050999 | A1 * | 2/2025 | Moromi | B63H 20/00 |

FOREIGN PATENT DOCUMENTS

| | | |
|---|---|---|
| JP | 2016074250 | 5/2016 |
| WO | 2020/069750 | 4/2020 |

OTHER PUBLICATIONS

Extended European Search Report mailed Oct. 13, 2025, in Corresponding European Application No. 25173023.0.

* cited by examiner

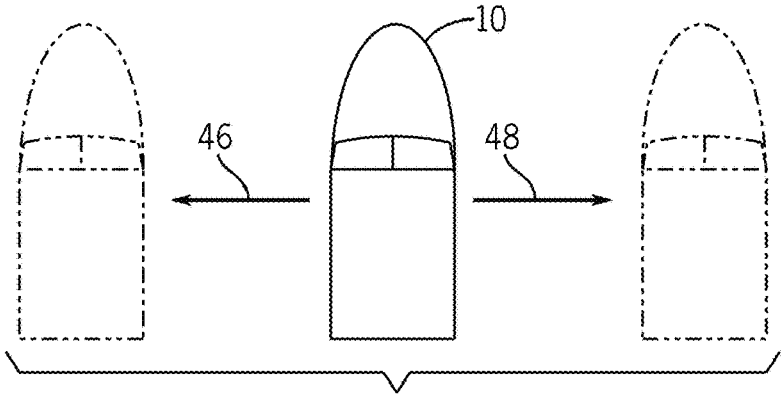
FIG. 2A
FIG. 2B
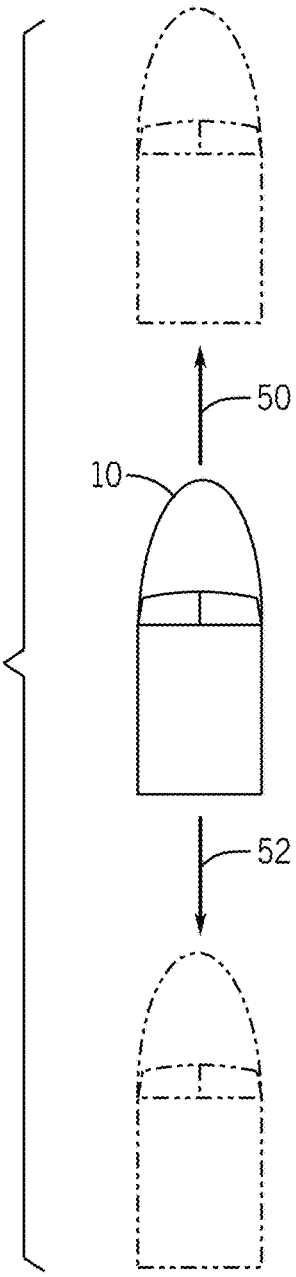

MARINE PROPULSION SYSTEM AND METHOD WITH SINGLE REAR DRIVE AND LATERAL MARINE DRIVE

FIELD

The present disclosure generally relates to methods and systems for propelling marine vessels, and more particularly to systems and methods for providing sway movement of the vessel.

BACKGROUND

Many different types of marine drives are well known to those skilled in the art. The steerable marine drive is steerable about its steering axis to a range of steering angles, which is effectuated by a steering actuator. Lateral marine drives may be positioned to exert lateral force on the marine vessel, such as bow thrusters. Marine drives generally comprise a powerhead, such as an electric motor or an internal combustion engine, driving rotation of a drive shaft that is directly or indirectly connected to a propeller on a propeller shaft and that imparts rotation thereto.

The following U.S. Patents are incorporated herein by reference, in entirety:

- U.S. Pat. No. 7,467,595 discloses a method for controlling the movement of a marine vessel that rotates one of a pair of marine drives and controls the thrust magnitudes of two marine drives. A joystick is provided to allow the operator of the marine vessel to select port-starboard, forward-reverse, and rotational direction commands that are interpreted by a controller which then changes the angular position of at least one of a pair of marine drives relative to its steering axis.
- U.S. Pat. No. 10,926,855 discloses a method for controlling low-speed propulsion of a marine vessel powered by a marine propulsion system having a plurality of propulsion devices that includes receiving a signal indicating a position of a manually operable input device movable to indicate desired vessel movement within three degrees of freedom, and associating the position of the manually operable input device with a desired inertial velocity of the marine vessel. A steering position command and an engine command are then determined for each of the plurality of propulsion devices based on the desired inertial velocity and the propulsion system is controlled accordingly. An actual velocity of the marine vessel is measured and a difference between the desired inertial velocity and the actual velocity is determined, where the difference is used as feedback in subsequent steering position command and engine command determinations.
- U.S. Pat. No. 11,091,243 discloses a propulsion system on a marine vessel that includes at least one steerable propulsion device and at least one lateral thruster. A steering wheel is mechanically connected to and operable by a user to steer the at least one propulsion device. A user interface device is operable by a user to provide at least a lateral thrust command to command lateral movement and a rotational thrust command to command rotational movement of the vessel. A controller is configured to determine a difference between a steering position of the propulsion device and a centered steering position. A user interface display is controllable to indicate at least one of the steering position of the propulsion device and the difference between the steering position and the centered steering position. The controller is further configured to determine that the steering position is within a threshold range of the centered steering position.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one aspect of the present disclosure, a marine propulsion system for a marine vessel includes one steerable rear marine drive positioned along a centerline of the marine vessel and configured to generate forward and reverse thrusts, wherein the rear marine drive is steerable about a vertical steering axis to a range of steering angles, a lateral marine drive, wherein the lateral marine drive is configured to generate lateral thrust on the marine vessel, a user input device operable by a user to provide a sway demand input commanding sway movement of the marine vessel, and a control system configured to automatically control steering and thrust of the one rear marine drive and thrust of the lateral marine drive based on the sway demand input to generate the sway movement commanded by the user.

In another embodiment, the lateral marine drive is positioned at a bow region of the marine vessel.

In another embodiment, the user input device is a joystick.

In another embodiment, the control system is further configured to, while the sway demand input is continually received, automatically control the one steerable rear marine drive to alternate between generating a forward thrust at a first steering position and generating a reverse thrust at a second steering position to effectuate the commanded sway movement of the marine vessel. Either the forward thrust or the reverse thrust may be generated first.

In a further embodiment, the first steering position is a maximum steering position in a first steering direction, and the second steering position is a maximum steering position in a second steering direction opposite the first steering direction.

In another embodiment, the control system is further configured to automatically control the one steerable marine drive to stop generating thrust output when the one steerable marine drive is moved between the first steering position and the second steering position.

In another embodiment, the control system is further configured to automatically control the one steerable rear marine drive to generate the forward thrust at the first steering position for a first predetermined time, and to generate the reverse thrust at the second steering position for a second predetermined time.

In a further embodiment, the second predetermined time is longer than the first predetermined time such that the reverse thrust is generated for longer than the forward thrust.

In another embodiment, the first period of time and the second period of time are the same amount of time.

In another embodiment, the control system is further configured to automatically control the one steerable rear marine drive to generate the forward thrust at the first steering position such that the marine vessel travels a first distance forward, and to generate the reverse thrust at the second steering position such that the marine vessel travels the first distance backward.

In another embodiment, the control system is further configured to automatically control the one steerable rear marine drive to generate the forward thrust at the first steering position such that the marine vessel travels a first speed magnitude in the forward direction, and to generate the reverse thrust at the second steering position such that the marine vessel travels the first speed magnitude in the backward direction.

In another aspect of the present disclosure, a method of controlling a marine propulsion system for a marine vessel includes only one steerable rear marine drive positioned along a centerline of the marine vessel and is configured to generate forward and reverse thrusts, wherein the rear marine drive is steerable about a vertical steering axis to a range of steering angles. The method includes receiving a sway demand input commanding sway movement of the marine vessel, and automatically controlling the one steerable rear marine drive to alternate between generating a forward thrust at a first steering position and generating a reverse thrust at a second steering position to effectuate the commanded sway movement of the marine vessel.

In one embodiment, the propulsion demand input is a user input at a joystick and the method further includes, while the sway demand input is continually received from the joystick, automatically controlling the one steerable rear marine drive to alternate between generating the forward thrust at the first steering position and generating the reverse thrust at the second steering position to effectuate the commanded sway movement of the marine vessel.

In another embodiment, the first steering position is a maximum steering position in a first steering direction, and the second steering position is a maximum steering position in a second steering direction opposite the first steering direction.

In another embodiment, the first steering position is in a first direction with respect to a centered position and the second steering position is in a second steering direction with respect to the centered position, wherein the second steering direction is opposite the first steering direction.

In another embodiment, the method further includes automatically controlling the one steerable marine drive to stop generating any thrust output when the one steerable marine drive is moved between the first steering position and the second steering position.

In another embodiment, the marine propulsion system includes at least one lateral marine drive positioned at a bow region of the marine vessel and configured to generate lateral thrust on the marine vessel, wherein the method further includes controlling the lateral marine drive to generate the lateral thrust based on the propulsion demand input to generate the sway movement commanded.

In another embodiment, the method further includes controlling the lateral marine drive to generate the lateral thrust when the one steerable rear marine drive is generating the forward thrust or the reverse thrust.

In another embodiment, the method further includes in response to the sway demand input, automatically controlling the one steerable rear marine drive to generate the forward thrust at the first steering position for a first predetermined time, and to generate the reverse thrust at the second steering position for a second predetermined time.

In another embodiment, the second predetermined time is longer than the first predetermined time such that the reverse thrust is generated for longer than the forward thrust.

In another embodiment, the first predetermined time and the second predetermined time are the same amount of time.

In another embodiment, the method further includes, in response to the sway demand input, automatically controlling the one steerable rear marine drive to generate the forward thrust at the first steering position such that the marine vessel travels a first distance forward, and to generate the reverse thrust at the second steering position such that the marine vessel travels the first distance backward.

In another embodiment, the method further includes, in response to the sway demand input, automatically controlling the one steerable rear marine drive to generate the forward thrust at the first steering position such that the marine vessel travels a first speed magnitude in the forward direction, and to generate the reverse thrust at the second steering position such that the marine vessel travels the first speed magnitude in the backward direction.

Various other features, objects, and advantages of the invention will be made apparent from the following description taken together with the drawings.

BRIEF DESCRIPTION OF THE DRAWINGS

The present disclosure is described with reference to the following Figures.

FIGS. 2A-2C are schematic illustrations of various movements of a marine vessel.

DETAILED DESCRIPTION

Figure 1:
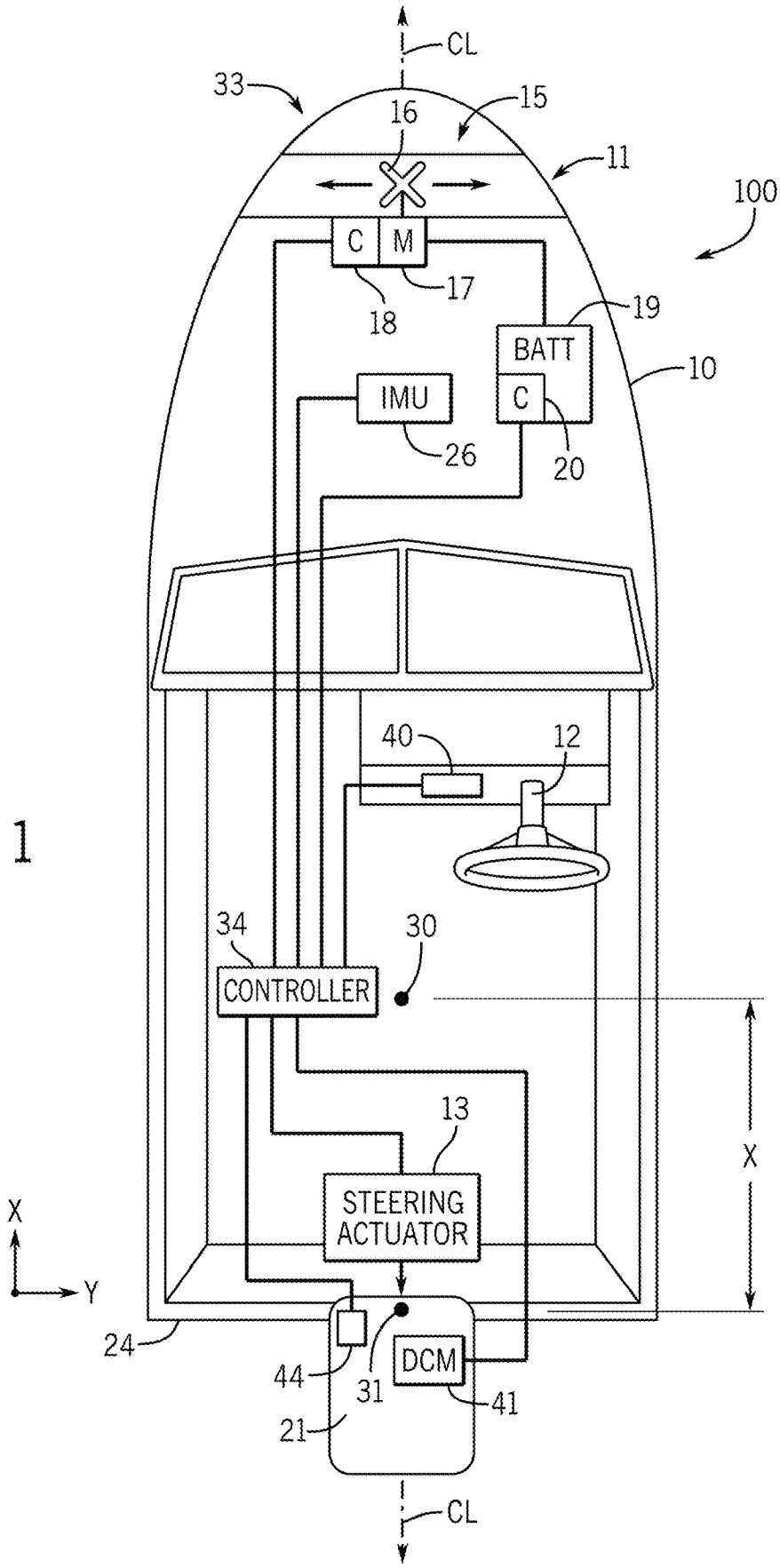
FIG. 1 is a schematic illustration of a marine vessel with one embodiment of a propulsion system according to the present disclosure.

The inventors have recognized a need for vessel control systems and methods that provide improved control over lateral movement of the marine vessel and enable sway movement (i.e., sideways movement), such as via joystick control, on a marine vessel with a single rear propulsion device. Sideways movement (or sway) is difficult on vessels with only a single rear drive because the lack of multiple drives does not enable thrust vector cancellation, particularly where the single rear marine drive has a limited steering angle range and is not able to rotate to 90 degrees from the centered steering position.

Based on the foregoing problems and challenges in the relevant art, the inventors developed the disclosed propulsion systems and methods to automatically control steering and thrust of a propulsion system with one rear marine drive to effectuate sway movement of the marine vessel. The propulsion system is configured to effectuate a sway demand input by automatically controlling the one steerable rear marine drive to alternate between generating a forward thrust at a first steering position and generating a reverse thrust at a second steering position to effectuate the commanded sway movement of the marine vessel. Thus, the single steerable rear marine dive is steered back and forth, such as between its maximum steering positions in each steering direction and controlled to alternately generate forward and reverse thrusts so as to move the vessel laterally (with some forward and back movement) in response to a sway command, such as a sway demand input by a user at a joystick. Thus, the sway command is effectuated by the propulsion system as a sideways motion of the vessel in the direction commanded with alternating forward and back components. Ideally, wherein the sway command is a straight lateral motion perpendicular to the centerline of the marine vessel, the forward and back components are approximately equal such that they cancel each other out over the course of vessel travel and the overall vessel motion approximates the commanded lateral motion.

In one embodiment, the control system may automatically control the steering and alternating thrust of the single rear marine drive to effectuate a predetermined time of active thrust in each direction. In another embodiment, the control system may automatically control the steering and alternating thrust of the single rear marine drive such that the marine vessel travels a distance forward and backward from the vessel position. In yet another embodiment, the control system may automatically control the steering and alternating thrust of the single rear marine drive such that the marine vessel reaches at least a threshold speed magnitude in the forward or backward directions (or, alternatively the rotational speed of the marine drive reaches a threshold rotational speed or threshold propeller speed).

In addition to a single steerable rear marine drive positioned at the stern of the marine vessel, a lateral marine drive may be positioned at the bow region and configured to generate starboard and port direction lateral thrusts. A user input device, such as a joystick, is configured to provide a unified control input for both the lateral drive and the rear drive—i.e., to control steering and thrust of the rear marine drive and to control thrust of a lateral marine drive based on a sway demand input at the user input device. The propulsion system is configured to coordinate the starboard and port thrusts from the lateral drive with the thrust from the steerable rear drive to effectively generate sway movement commanded by the user—i.e., to move the vessel sideways. Coordination of thrusts from the steerable rear drive and the lateral drive may include timing the thrust at intervals, wherein both drives activate at the same time or at overlapping intervals.

The lateral marine drive may be mounted in an area of the bow of the marine vessel and controllable in forward and reverse directions to generate starboard and port directional thrusts at the bow. In an example where the lateral marine drive is an electric drive, such as a variable speed thruster, thrust magnitude and direction generated by the lateral marine drive can be quickly and precisely controlled, such as through pulsing, to fine-tune the total sway thrust effectuated by the propulsion system. The lateral marine drive may be mounted at a fixed angle with respect to the vessel such that it is not steerable and is configured to generate starboard and port thrusts at a fixed angle—i.e., lateral thrusts that are perpendicular to the centerline of the vessel. Alternatively, the lateral marine drive may be a steerable drive, such as a steerable thruster. In certain embodiments, the starboard or port thrust, including the yaw moment of the lateral marine drive thrust, is integrated into and accounted for in the propulsion control scheme such that the thrusts generated by the lateral marine drive and the rear marine drive are totaled and each individual drive is controlled so that the total sway thrust effectuated by all drives in the propulsion system results in a thrust that approximates the commanded lateral sway movement as closely as possible. The control system may automatically control the thrust of the lateral drive and the rear marine drive based on a predetermined time of active thrust, a distance forward or backward from the vessel position, and/or a speed magnitude in the forward or backward direction.

FIG. 1 is a schematic representation of a marine vessel 10 equipped with propulsion system 100 including one rear marine drive 21 positioned at or near the stern 24, such as attached to the transom. The single rear marine drive 21 may be mounted along a centerline CL of vessel 10, which is to be understood as generally laterally centered with respect to the beam of the vessel 10 such that when the steerable rear marine drive 21 is in a centered steering position it propels the marine vessel approximately or exactly straight ahead (under ideal conditions with no current, wind, or other lateral forces). The single rear marine drive 21 may be, for example, an outboard drive, a stern drive, an inboard drive, a jet drive, or any other type of steerable drive. The rear marine drive 21 is steerable, having a steering actuator 13 configured to rotate the drive 21 about its vertical steering axis 31. The steering axis 31 is positioned at a distance X from the center of turn (COT) 30, which could also be the effective center of gravity (COG).

The marine vessel 10 is maneuvered by causing the rear marine drive to rotate about its steering axis 31. The rear marine drive 21 is rotated in response to a steering instruction, such as in response to an operator's manipulation of the steering wheel 12 or user input device 40, which is communicatively connected (directly or indirectly) to the steering actuator 13 to rotate the marine drive 21. Rotating the rear marine drive 21 and effectuating thrust thereby causes a rotational moment tending to cause rotation of the marine vessel 10 about the effective COT 30 as well as translational movement.

The propulsion system 100 further includes a lateral marine drive 15 configured to effectuate lateral thrust on the vessel 10 in the starboard and port directions. The lateral marine drive may be fixed, not steerable, such that it produces port-direction or starboard-direction lateral thrusts at fixed angles with respect to the marine vessel, such as perpendicular to the centerline CL. In the depicted example, the lateral marine drive 15 is an electric drive positioned at a bow region 11 of the vessel 10 configured to effectuate lateral thrust at the bow, which may also be referred to as a bow thruster. The bow region 11 is near the bow of the vessel so as to be in front (toward the bow) of the COT 30. Bow thrusters are known to those skilled in the art, as are other types and locations of marine drive arrangements configured to only effectuate lateral thrusts on the vessel 10, which may be placed at other locations on the vessel 10 besides the bow region 11.

The lateral marine drive 15 may be a discrete drive, or discrete thruster, that operates only at a predetermined RPM and thus is only controllable by turning on and off the drive. Alternatively, the lateral marine drive 15 may be a proportional drive, or proportional thruster, wherein the rotational speed (e.g., rotations per minute RPM) is controllable by the control system 33 between a minimum RPM and a maximum RPM that the drive is capable or rated to provide. A person having ordinary skill in the art will understand in view of the present disclosure that the disclosed propulsion system 100 may include other types and locations of lateral marine drives 15, which may be an alternative to or in addition to a lateral drive 15 positioned at the bow.

The lateral marine drive 15 may include a propeller 16, sometimes referred to as a fan, that is rotated by a bi-directional motor 17 in forward or reverse direction to effectuate lateral thrust in the starboard or port directions. In such an embodiment, the lateral marine drive 15 is configured to rotate in a first direction to generate a starboard direction lateral thrust and to rotate in an opposite direction of the first direction to generate a port direction lateral thrust. The controller 34 may be communicatively connected to a drive controller 18 for the lateral marine drive 15 to control activation and direction of thrust by the lateral marine drive 15. Where the lateral drive 15 is configured as a discrete drive, the drive controller 18 provides on/off and directional control of the motor 17, and thus to rotate in the clockwise and counterclockwise directions at a single speed. The drive controller 18 (alone or in conjunction with the central controller 34) may be configured to modulate the duty cycle of the discrete lateral drive to achieve desired thrust outputs. In other embodiments, the lateral marine drive 15 is a variable speed drive, wherein the motor 17 is controllable to rotate the propeller 16 at two or more speeds. For example, the motor 17 may be a brushless DC motor configured for variable multi-speed control of the propeller 16 in both the clockwise and counterclockwise rotation directions to effectuate a range of lateral thrust outputs.

Where one or more of the marine drives 15, 21 is an electric drive—i.e., having a powerhead being an electric motor—the propulsion system 100 will include a power storage device 19 powering the motor(s) thereof. The power storage device 19, such as a battery (e.g., a lithium-ion battery) or bank of batteries, stores energy for powering the electric motor(s) (e.g., motor 17) and is rechargeable, such as by connection to shore power when the electric motor is not in use or by an on-board alternator system drawing energy from engine-driven marine drives (if any) on the marine vessel. The power storage device 19 may include a battery controller 20 configured to monitor and/or control aspects of the power storage device 19. For example, the battery controller 20 may receive inputs from one or more sensors within the power storage device 19, such as a temperature sensor configured to sense a temperature within a housing of the power storage device where one or more batteries or other storage elements are located. The battery controller 20 may further be configured to receive information from current, voltage, and/or other sensors within the power storage device 19, such as to receive information about the voltage, current, and temperature of each battery cell within the power storage device 19. In addition to the temperature of the power storage device, the battery controller 20 may be configured to determine and communicate a charge level to the central controller 34 and/or another controller within the control system 33. The charge level may include one or more of, for example, a voltage level of the power storage device, a state of charge of the power storage device 19, a state of health of the power storage device 19, etc.

The controller 34 may be configured to receive input from an inertial measurement unit (IMU) 26 configured to measure movement and/or position of the marine vessel, such as rotational and/or translational movements, and may use such information as the basis for controlling prolusion. For example, the IMU 26 may include a solid state, rate gyro electronic compass that indicates the vessel heading and solid state accelerometers and angular rate sensors that sense the vessel's attitude and rate of turn. Specifically, the IMU 26 may include a 3-axis accelerometer, a 3-axis gyroscope, and a 3-axis magnetometer, and measure the acceleration, orientation, and direction of the marine vessel 10 in nine degrees of freedom. Alternatively or additionally, the controller 34 may be configured to receive input from a global position tracking system configured to determine and track position of the vessel 10, such as a global positioning system (GPS). The global positioning system may include an antenna that is configured to receive satellite signals from relevant satellites (e.g., GPS satellites or GLONASS satellites) that are processed at a receiver or processing unit to determine a global position of the marine vessel 10. In an exemplary implementation, the position of the global position antenna relative to the center of rotation 12 of the marine vessel 10 may be known by the system such that the global position of the center of rotation 12 can be determined.

Figure 2C:
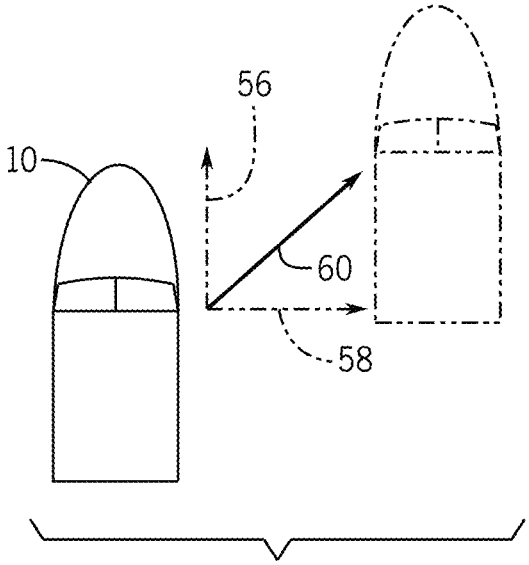

The propulsion system 100 further includes a user input device 40, such as a joystick or a keypad, operable by a user to provide at least a lateral movement demand input. The user input device enables a user to give a lateral propulsion demand commanding sway movement of the marine vessel, or longitudinal movement along the y-axis, which will be effectuated by the propulsion system as a sway motion with alternating forward and back components. FIGS. 2A-2C illustrate exemplary vessel movements that may be commanded via the user input device 40. FIG. 2A shows the vessel 10 moving laterally, or sway movement, in the port direction 46 and the starboard direction 48 without any forward or reverse motion and without any rotation about its COT 30. FIG. 2B shows the vessel 10 moving in the forward 50 direction and backward 52 direction, also known as surge movement. FIG. 2C shows a combination of forward surge and starboard sway motions of the vessel 10, where the surge movement is represented by the dashed arrow 56 and the sway movement is represented by the dashed arrow 58. The resultant motion vector 60 moves the vessel in the forward and starboard directions without any rotation.

The disclosed system and method enable lateral movement of the marine vessel, such as that illustrated in FIGS. 2A-2C, by effectuating steering and thrust control of the rear marine drive 21 and thrust control of the lateral marine drive 15 that approximate the illustrated movement directions over a vessel course. The system 100 is configured to provide translational movement in other translational directions combining forward/reverse and port/starboard thrusts of the rear and lateral drives 21 and 15, where the uncommanded forward and reverse portions of the vessel movement cancel each other out over the course traveled by the vessel.

The user inputs provided at the user input device 40 are received by the control system 33, which may include multiple control devices communicatively connected via a communication link, such as a CAN bus (e.g., a CAN Kingdom Network), to control the propulsion system 100 as described herein. In the embodiment of FIG. 1, the control system 33 includes a central controller 34 communicatively connected to the drive control module (DCM) 41 of the rear marine drive 21, the DCM 18 of the lateral marine drive 15, and may also include other control devices such as the battery controller 20. Thereby, the controller 34 can communicate instructions to the DCM 41 of the rear drive to effectuate a commanded magnitude of thrust and a commanded direction of thrust (forward or reverse), as is necessary to effectuate the inputs commanded at the user input device 40, including the surge and sway demand inputs discussed herein as well as rotational thrust directions not addressed in the current application. The controller also communicates a steering position command to the steering actuator 13 to steer the marine drive 21. Drive position sensor 44 is configured to sense the steering angle, or steering position, of the drive 21. The central controller 34 also communicates a command instruction to the DCM 18 for the lateral marine drive, wherein the commands to the various drives 15, 21 are coordinated such that the total of the thrusts from the rear and lateral marine drives over time approximates the user's propulsion demand input. A person of ordinary skill in the art will understand in view of the present disclosure that other control arrangements could be implemented and are within the scope of the present disclosure, and that the control functions described herein may be combined into a single controller or divided into any number of a plurality of distributed controllers that are communicatively connected.

Figure 3:
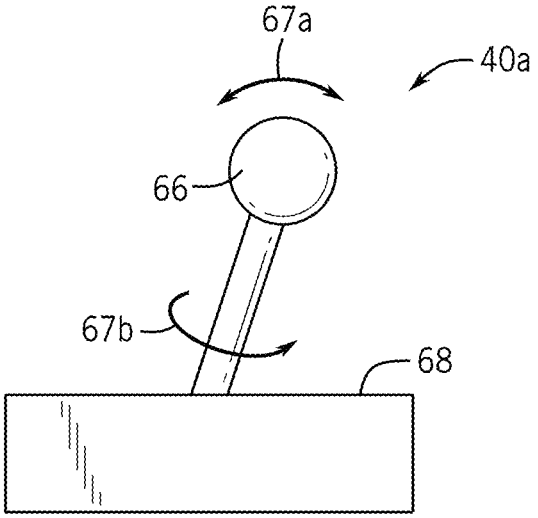
FIG. 3 illustrates an exemplary joystick user input device.
Figure 4:
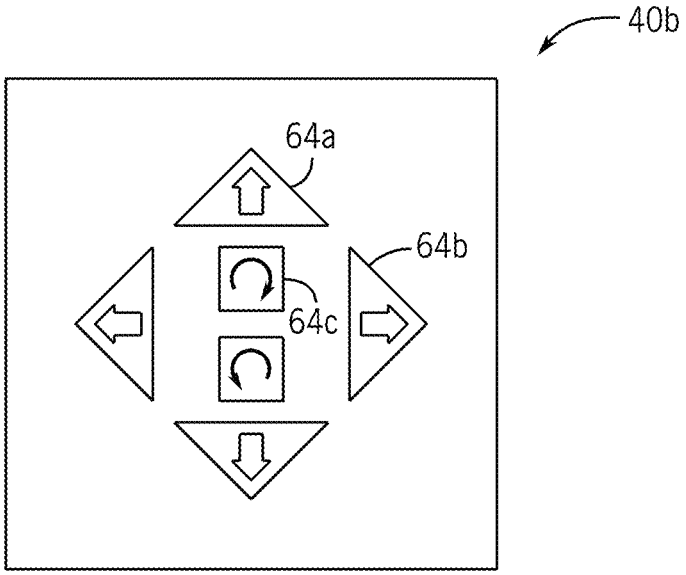
FIG. 4 illustrates an exemplary keypad user input device.

FIGS. 3 and 4 exemplify two possible types of user input devices 40. FIG. 3 depicts a well-known joystick 40*a* user input device that comprises a base 68 and a moveable handle 66 suitable for movement by an operator. Typically, the handle can be moved left and right (represented by arrow 67*a*), forward and back, as well as twisted (represented by arrow 67*b*) relative to the base 68 to provide corresponding movement commands for the propulsion system. FIG. 4 depicts an alternative user input device 40*b* being a keypad with buttons 64 associated with each of the right, left, forward, backward, and rotational movement directions. Thus, a forward button 64*a* can be pressed by a user to provide a forward thrust command to move the marine vessel forward and key 64*b* can be pressed by a user to input a lateral thrust command to command lateral movement of the marine vessel 10. Similarly, the clockwise rotation key 64*c* can be pressed by a user to input a clockwise rotational thrust command to command clockwise rotational movement of the marine vessel 10. The other keys on the keypad 40*b* operate similarly. The joystick 40*a* and keypad 40*b* are merely exemplary, and other types of user input devices enabling a user to command lateral and rotational movement are within the scope of the present disclosure.

The propulsion system 100 may be configured such that the user can select an operation mode for the user input device 40, for example via buttons or other user interface elements on the joystick or elsewhere at the helm. Alternatively or additionally, the system 100 may be configured to automatically select one or more of the operation modes based on engagement of various user input devices. To provide one example, the controller 34 may automatically engage the joystick control mode if the joystick 40*a* (or other multi-directional user interface device 40) is engaged and one or more helm levers (e.g., throttle/shift levers) associated with the rear marine drive 21 are not being operated to control the drive 21. For example, the joystick mode may be selectable by engaging the user interface 40, such as the joystick or touchpad, and disengaging all other helm thrust control elements for the marine drives, such as putting all throttle/shift levers in neutral or otherwise deactivating the steering and/or thrust control functions.

The disclosed propulsion system 100 enables joystick control, or control by another user input device operable to provide lateral thrust control for propulsion systems that only include one rear marine drive, and may provide lateral vessel motion by controlling thrust output of both the rear and lateral marine drives. Optionally, such as based on a mode selection, the drives may be controlled automatically based on a single user input commanding a thrust magnitude and direction such that the drives operate to provide precise and seamless sway control of the vessel 10. Alternatively, the sway demand input may be generated by a navigation controller as part of an activated navigation mode, such as a docking mode, a station keeping mode, a waypoint navigation mode, or other autonomous navigation mode wherein the steering and propulsion output are automatically controlled by the control system.

Figure 5:
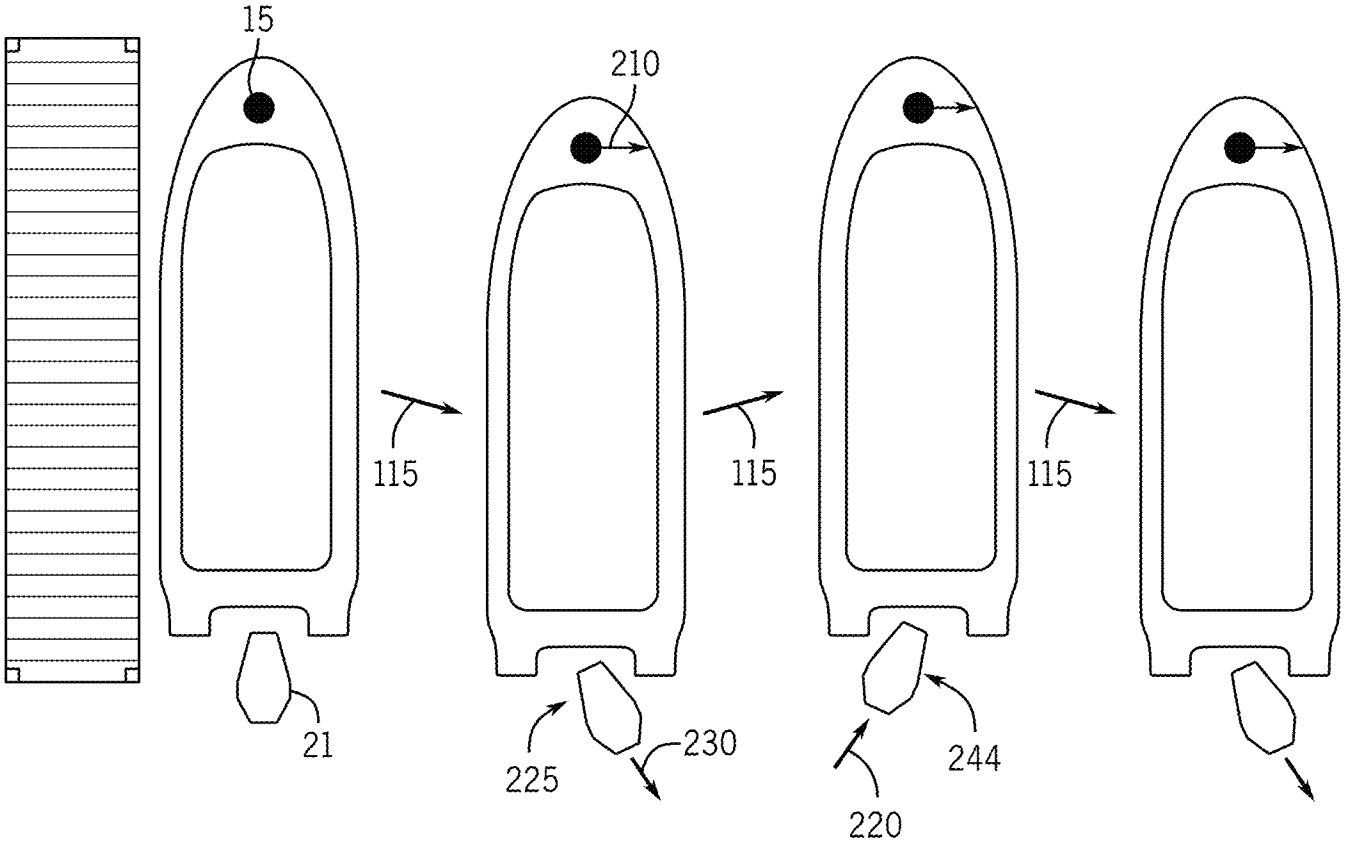
FIG. 5 depicts combinations of thrust vectors by the exemplary propulsion system of FIG. 1 to effectuate exemplary sway movements of the vessel.
Figure 6:
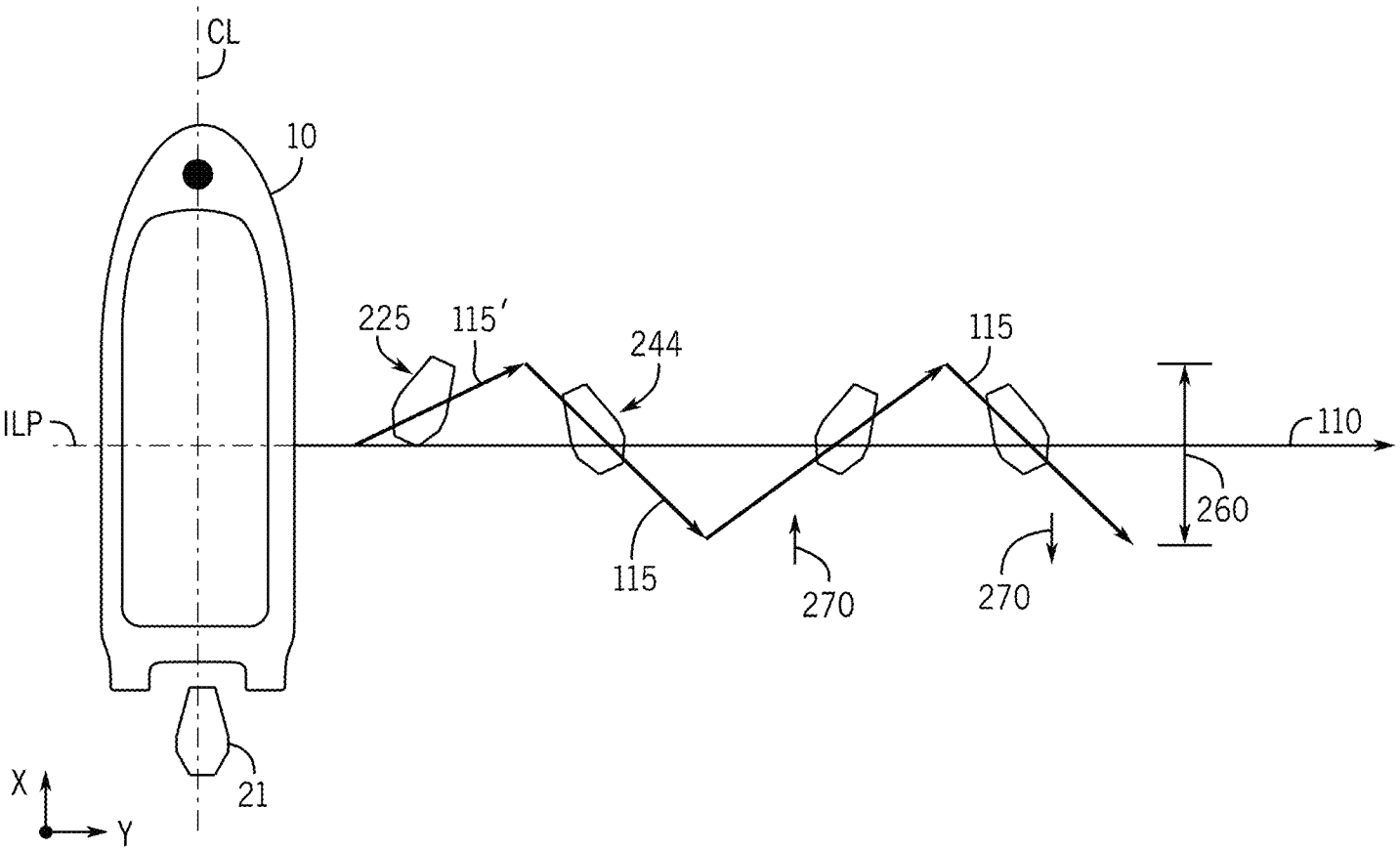
FIG. 6 depicts combinations of thrust vectors by the exemplary propulsion system of FIG. 1 to effectuate exemplary sway movements of the vessel.

Referring to FIGS. 5 and 6, a marine propulsion system is exemplified comprising one steerable rear marine drive 21 positioned along a centerline CL of the marine vessel 10 and configured to move the vessel laterally in response to a sway command. The marine propulsion system does not include any other steerable rear marine drive other than the one steerable rear marine drive 21 positioned at the centerline CL. In one embodiment, the propulsion system includes only the steerable rear marine drive 21 and a fixed lateral drive 15 at the bow region, and no other marine drive. Upon receiving a sway demand input commanding sway movement of the marine vessel, such as at a joystick, the control system automatically controls the one steerable rear marine drive 21 to alternate between generating a forward thrust at a first steering position and generating a reverse thrust at a second steering position to effectuate movement of the vessel 115 that approximates the commanded sway direction. Depending on the commanded thrust direction and the vessel conditions, the system may generate the forward thrust first or the reverse thrust first. The first steering position may be either a starboard side steering position or a port side steering position. The second steering position is in the opposite direction of the centered steering position as the first steering position.

The control system is configured to determine which direction of thrust is to be effectuated with each steering direction based on the direction of the sway demand input. The control system may be configured to determine which propulsion direction should be executed first, between the forward and reverse propulsion directions, based on a current movement direction of the marine vessel (e.g., residual movement from a previous propulsion command or vessel motion caused by environmental forces such as current or wind), a vessel location, proximity of surrounding obstacles, and/or any other of a number of other factors.

Since the rear marine drive is not steerable to 90 degrees, lateral movement with the single rear marine drive results in at least some forward and backward movement during lateral translation. As shown in FIG. 6, the vessel course 115 effectuated in response to a sway demand input commanding sway (lateral) motion in the starboard direction includes some forward and backwards motion in conjunction with the lateral motion. The direction 110 of the sway demand input is superimposed over the vessel course 115 for illustrative purposes to indicate the commanded lateral direction of the sway demand input 110 as received via the user input device.

While the sway demand input 110 is continually received from the user input device, such as a joystick, the control system is configured to automatically control the one steerable rear marine drive 21 to alternate between generating a reverse thrust 230 at a first steering position 225 and generating a forward thrust 220 at a second steering position 244 to effectuate the commanded sway movement of the marine vessel. The thrust direction is effectuated based on the first steering direction and the direction of the sway demand input. For example, the first steering direction may be a predetermined direction, or may be selected by the control system based on the first thrust direction (being forward or reverse) and the direction of the sway demand input.

The control system is further configured to automatically control the one steerable marine drive 21 to stop generating thrust output when the one steerable marine drive 21 is moved between the first steering position 225 and the second steering position 244. Thus, the thrust output is intermittent, wherein thrust is outputted while the rear marine drive 21 is at the first steering position 225 and then the thrust output stops until the marine drive is in the second steering position 244.

The first and second steering positions 225 and 244 may be the maximum steering positions within the range of steering angles permitted for the rear marine drive 21. The second steering position 244 is in a second steering direction opposite the first steering direction. Referring again to the example in FIG. 5, where the first steering position 224 is a maximum steering position in the starboard direction, the second steering position 244 may be a maximum steering position in the port direction.

To provide additional sway movement, the lateral marine drive 15 is configured to generate lateral thrust 210 on the marine vessel 10 in the commanded sway direction. In some embodiments, the lateral marine drive may also be controlled to counteract yaw movements and thus to help keep the vessel pointed in the proper heading direction, such as described at U.S. patent application Ser. No. 17/869,515, which is hereby incorporated by reference in its entirety. In one embodiment, the control system is configured to control the lateral marine drive 15 to generate the lateral thrust 210 to move the vessel in the commanded sway direction when the one steerable rear marine drive 21 is generating the forward thrust 220 or the reverse thrust 230. Alternatively, the lateral thrust from the lateral marine drive 15 may be pulsed or occur intermittently at the same or different predetermined time periods than the thrust generated by the rear marine drive 21.

The control system is configured to automatically control the drives to alternate the first and second steering positions and thrust directions while the lateral thrust command is provided. In one embodiment, the control system is configured to generate each of the forward and reverse thrusts for predetermined times. In such an embodiment, the reverse thrust 230 is generated for a first predetermined time, and the forward thrust 220 is generated for a second predetermined time. The first and second predetermined times may be the same, or they may be different such that one of the predetermined times is longer than the other. For example, because effectuation of a forward vessel movement is more efficient than reverse vessel movement (e.g., because of the hull dynamics, the transmission and powerhead configurations, and/or the propeller configuration), the predetermined time for effectuating the reverse thrust may be longer than the predetermined time for effectuating forward thrust such that the reverse thrust is generated for longer than the forward thrust. The first and second predetermined times may be calibrated such that they generate approximately the same amount of vessel travel in each of the forward and backward directions.

In another embodiment, the control system may be configured to, in response to the sway demand input 110, automatically control the rear marine drive to generate the forward and reverse thrusts based on sensed vessel movement such that the vessel moves a predetermined distance in each of the forward and backward directions. As exemplified in FIG. 6, in response to the starboard sway command, the one steerable rear marine drive 21 is controlled to generate the forward thrust at the first steering position 225 such that the marine vessel 10 travels a first distance 260 forward, and to generate the reverse thrust at the second steering position 244 such that the marine vessel 10 travels the first distance 260 backward. The control system is configured to measure the distance of the marine vessel 10 via a sensor configured to measure vessel position or movement, such as a GPS system and/or an IMU 26. The first distance 260 forward and backward may be measured based on the initial longitudinal position ILP of the marine vessel when the sway command was generated (i.e., at the location on the X axis demarcated by line 110), or based on the start position of the vessel when the thrust switches from forward to reverse or vice versa.

For example, the measured distance may be measured as the vessel GPS position along a GPS coordinate axis that runs parallel with the centerline CL of the vessel. If the distance is measured with respect to the initial longitudinal position ILP of the vessel, then the vessel should cross the initial position ILP during each forward and backward movement at half of the first distance (other than the initial leg 115' of the vessel course 115). For the initial leg 115' of the response, the forward/backward distance may be half of the first distance 260. Thereby, the uncommanded motion of the vessel in the forward or backward directions for each leg of the course 115 is half of the first distance 260 (or close thereto). By measuring the distance forward or backward, the control system may be able to more precisely execute the commanded sway movement, particularly in an environment with a strong current or strong winds.

The magnitude of the distance threshold set for the first distance may be calibratable based on, but not limited to, the vessel size, vessel weith, vessel dynamics, propulsion type (e.g., ICE or electric), and/or the like. Alternatively or additionally, the control system may be configured to determine the threshold distance to be used as the first distance based on a magnitude of the demand input (e.g., the magnitude of the joystick deflection or the lateral velocity commanded by the navigation controller). Alternatively or additionally, the control system may be configured to determine the threshold distance based on the environment (e.g., proximity of nearby objects) or the control mode engaged (e.g., docking mode versus a higher speed joysticking mode).

In another embodiment, in response to the sway demand input 110, the control system may be configured to automatically control the forward and reverse thrusts based on vessel velocity. For example, the one steerable rear marine drive 21 may be controlled to generate the forward thrust at the first steering position 225 such that the marine vessel 10 travels a first speed magnitude 270 in the forward direction, and to generate the reverse thrust at the second steering position 244 such that the marine vessel 10 travels the first speed magnitude 270 in the backward direction. In one embodiment, the speed magnitude for initial leg 115' of the vessel course 115 is half of the first speed magnitude 270. The speed magnitude threshold may be calibratable based on, but not limited to, the vessel size, vessel weith, vessel dynamics, propulsion type (e.g., ICE or electric), and/or the like. Alternatively or additionally, the control system may be configured to determine the threshold speed magnitude based on the magnitude of the demand input (e.g., the magnitude of the joystick deflection or the lateral velocity commanded by the navigation controller), and/or based on the environment (e.g., proximity of nearby objects) or the control mode engaged. In another embodiment, the control system may measure both a distance 260 forward and backward and a speed magnitude 270 in each of the forward or backward directions. For example, the control system may be configured to trigger the marine drive to switch directions based on whichever threshold is reached first.

The forward and reverse thrust commands may be provided by open loop control (such as in the embodiment where each thrust command is provided for a predetermined time), or by a closed loop control configuration where vessel position measurements and/or vessel velocity in a given direction is utilized as feedback for controlling the thrust output of the single rear marine drive 21 and the lateral drive 15. For example, the control system may be configured to reduce the thrust output as the vessel reaches the first distance or the first speed magnitude and to cease thrust output once the threshold distance or speed magnitude in the given direction is reached.

Figure 7:
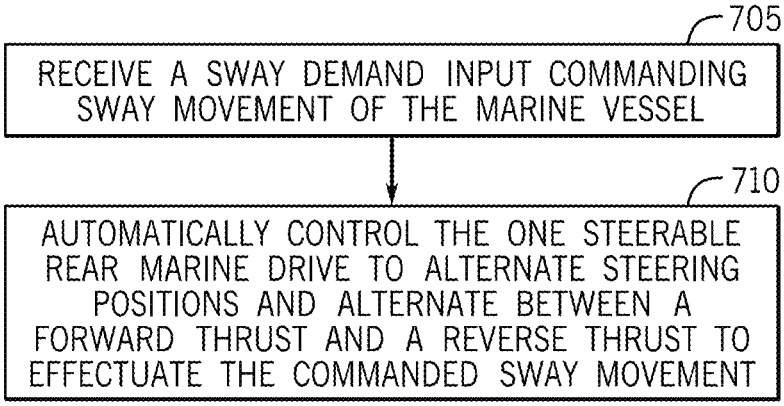
FIG. 7 is a depiction of exemplary method steps for controlling a marine propulsion system according to the present disclosure.

Referring now to FIG. 7, exemplary method steps for controlling a marine propulsion system for a marine vessel are illustrated. At 705, a sway demand input is received by the control system commanding sway movement of the marine vessel. The sway demand input from a user input device, such as a lateral movement commanded through the movement of the joystick handle sideways in the starboard or port directions. At 710, the one steerable rear marine drive is automatically controlled to alternate between starboard and port steering positions and between a forward thrust and a reverse thrust to effectuate the commanded sway movement. Determination of the timing and duration of active thrust for the forward thrust and the reverse thrust may be based on a predetermined time, a measured distance forward and backward, and/or a measured speed magnitude in the forward and backward direction. In one embodiment, the control system may control the one steerable rear marine drive to generate the forward thrust and reverse thrust based on a combination of these criteria, such as based on a measured distance and a speed magnitude in the forward or backward direction.

Figure 8:
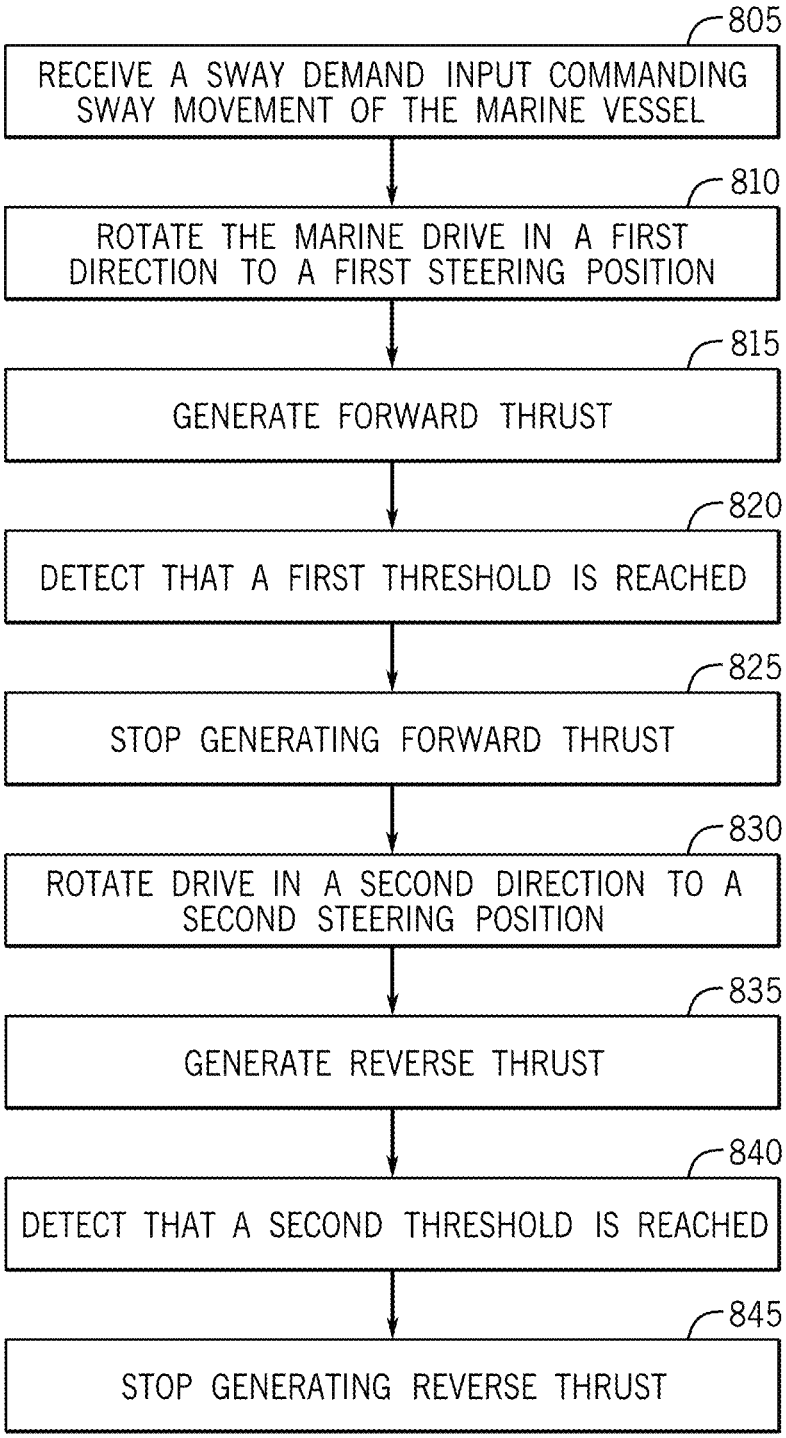
FIGS. 8-9 are exemplary flow charts depicting exemplary methods of controlling a marine propulsion system according to the present disclosure.

Referring now to FIG. 8, an exemplary flow chart for controlling a marine propulsion system for a marine vessel is illustrated. At step 805, a sway demand input is received commanding sway movement of the marine vessel. At step 810, the marine drive is rotated in a first direction by the control system to a first steering position. The first steering position may be at a maximum steering position in the first steering direction (which may be moving the drive in the starboard or port direction from the centerline of the marine vessel). At step 815, a forward thrust is generated. At step 820, a detected first threshold is reached. The first threshold may be measured in terms of time, distance, speed magnitude, or a combination thereof. The first threshold may be configured to maximize movement in the lateral direction or reduce movement in the forward or backward direction. At step 825, the control system controls the rear marine drive to stop generating a forward thrust. Stopping the generation of a forward thrust when switching between a first steering position and a second steering position increases the navigation control of the vessel, wherein thrust generated while switching between steering positions would increase the movement of the vessel in directions other than the lateral movement commanded by the sway demand input. At step 830, the rear marine drive is rotated in a second direction opposite the first direction to a second steering position. In one embodiment, the second steering position is the opposite maximum steering position from the first steering position. Thus, the marine drive is steered to the maximum steering position in each of the port and starboard directions within the allowable range of steering angles. At step 835, the control system generates a reverse thrust. At step 840, the control system detects that a second threshold is reached. The second threshold may be the same or different than the first threshold, as is described herein. At step 845, the control system controls the rear marine drive to stop generating the reverse thrust.

Figure 9:
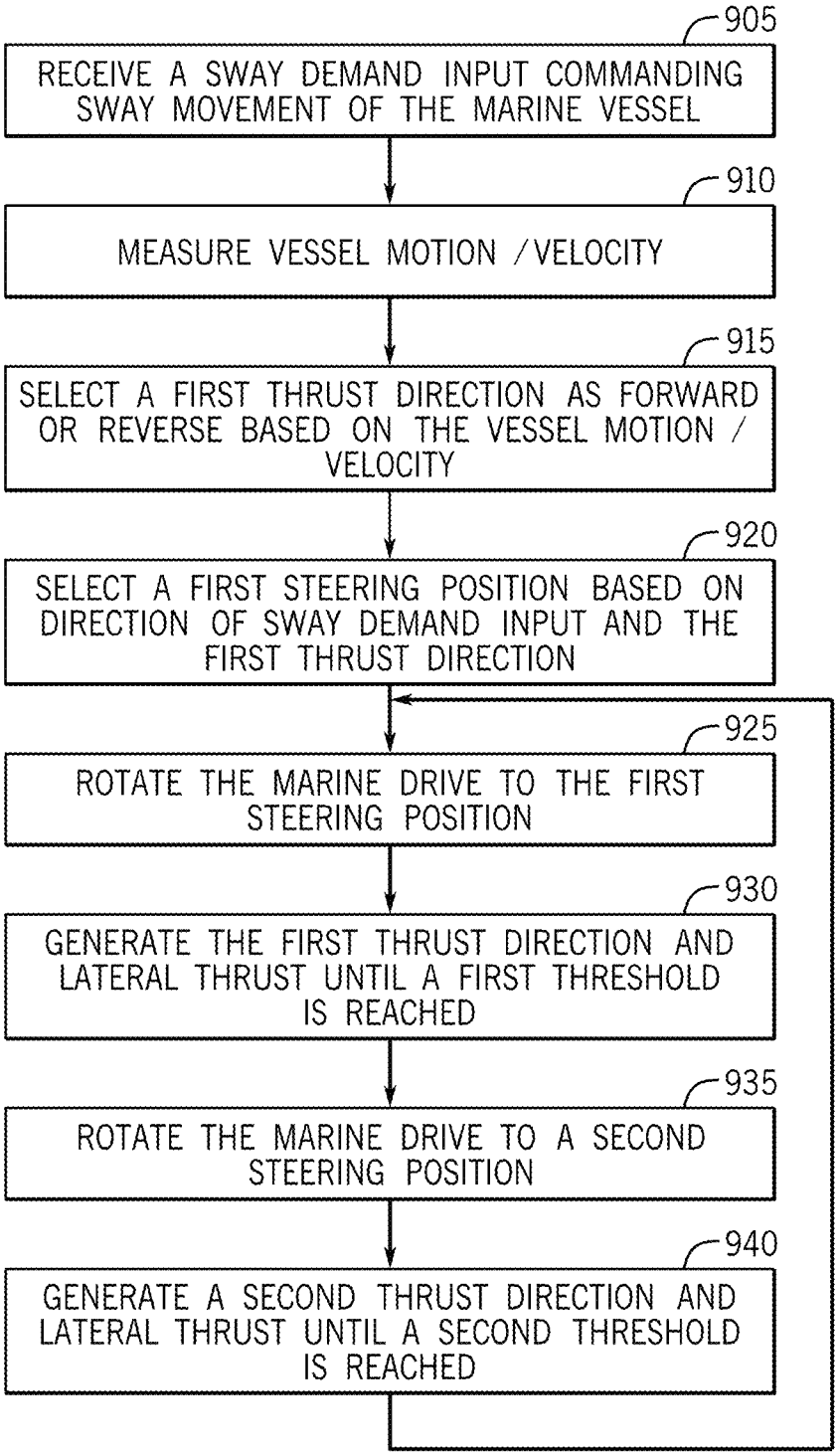

Referring now to FIG. 9, an exemplary flow chart for controlling a marine propulsion system for a marine vessel is illustrated. At step 905, a sway demand input is received commanding sway movement of the marine vessel. In one embodiment, the sway demand input is received as a user input, such as at a joystick or other user input device. In another embodiment, the sway demand input may be generated by a navigation controller as part of an activated navigation mode, such as docking, wherein a generated navigation pathway or other navigation function requires sway movement, such as moving towards or away from a docking surface. At step 910, a vessel motion and/or velocity is measured. Measurement of the vessel motion and/or velocity may include measurements received from sensors on the marine vessel, such as a speed sensor or a pitot tube. Additionally or alternatively, the motion and/or velocity measurements may include measurements from a position measurement or motion device, such as a GPS or an IMU. At step 915, a first thrust direction is selected as forward or reverse based on the vessel motion/velocity. For example, the first thrust direction for the initial leg of the vessel course may be selected by the control system to counteract a current motion of the vessel, such as motion due to current or wind or residual motion of the vessel from a previous thrust output. Alternatively or additionally, the first thrust direction may be selected based on a comparison of the current vessel position to a target vessel position (such as with autonomous navigation where the propulsion system is being automatically controlled by a navigation controller operating in a mode to follow a navigation pathway).

At step 920, a first steering position is selected based on the first thrust direction to effectuate vessel motion in the direction commanded by the sway demand input. At step 925, the marine drive is automatically rotated by the control system to the first steering position. At step 930, the rear marine drive is controlled to generate thrust in the first thrust direction and the lateral marine drive is controlled to generate lateral thrust until a first threshold is reached (note that for the first leg of the vessel course, the first threshold may be half of the value utilized for the remainder of the propulsion control algorithm, as is described above). At step 935, the marine drive is automatically rotated to a second steering position. At 940, the rear marine drive is automatically controlled to generate thrust in the second thrust direction (either forward or reverse, opposite the first thrust direction) and the lateral marine drive is controlled to generate lateral thrust until a second threshold is reached. Steps 925-940 are repeated while the sway demand input is maintained, alternating between the first steering position and the second steering position until the sway demand input ceases. In one embodiment with autonomous navigation, the sway demand input ceases when the marine vessel reaches the target location. Alternatively, steps 925-940 may repeat until continuous sway demand input by a user stops, such as when the joystick is released from a held lateral deflection position to a neutral position.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A marine propulsion system for a marine vessel comprising:

one steerable rear marine drive positioned along a centerline of the marine vessel and configured to generate forward and reverse thrusts, wherein the one steerable rear marine drive is steerable about a vertical steering axis to a range of steering angles;

a lateral marine drive positioned at a bow region of the marine vessel, wherein the lateral marine drive is configured to generate lateral thrust on the marine vessel;

a user input device operable by a user to provide a sway demand input commanding sway movement of the marine vessel; and a control system configured to automatically control steering and thrust of the one steerable rear marine drive and thrust of the lateral marine drive based on the sway demand input to generate the sway movement commanded by the user, including, while the sway demand input is continually received, automatically control the one steerable rear marine drive to alternate between generating a forward thrust for a first predetermined time at a first steering position in the range of steering angles and generating a reverse thrust for a second predetermined time at a second steering position in the range of steering angles to effectuate the commanded sway movement of the marine vessel.

2. The system of claim 1, wherein the user input device is a joystick.

3. The system of claim 1, wherein the first steering position is a maximum steering position in a first steering direction, and wherein the second steering position is a maximum steering position in a second steering direction opposite the first steering direction.

4. The system of claim 1, wherein the control system is further configured to automatically control the one steerable rear marine drive to stop generating thrust output when the one steerable marine drive is moved between the first steering position and the second steering position.

5. The system of claim 1, wherein the second predetermined time is longer than the first predetermined time such that the reverse thrust is generated for longer than the forward thrust.

6. The system of claim 1, wherein the first predetermined time and the second predetermined time are the same amount of time.

7. The system of claim 1, wherein the control system is further configured to automatically control the one steerable rear marine drive to generate the forward thrust at the first steering position such that the marine vessel travels a first distance in a forward direction, and to generate the reverse thrust at the second steering position such that the marine vessel travels the first distance in a backward direction.

8. The system of claim 1, wherein the control system is further configured to automatically control the one steerable rear marine drive to generate the forward thrust at the first steering position such that the marine vessel travels a first speed magnitude in a forward direction, and to generate the reverse thrust at the second steering position such that the marine vessel travels the first speed magnitude in a backward direction.

9. A method of controlling a marine propulsion system for a marine vessel, wherein the marine propulsion system includes only one steerable rear marine drive positioned along a centerline of the marine vessel and configured to generate forward and reverse thrusts, wherein the one steerable rear marine drive is steerable about a vertical steering axis to a range of steering angles, the method comprising:

receiving a sway demand input commanding sway movement of the marine vessel; and in response to the sway demand input, automatically controlling the one steerable rear marine drive to alternate between generating a forward thrust for a first predetermined time at a first steering position in the range of steering angles and generating a reverse thrust for second predetermined time at a second steering position in the range of steering angles to effectuate the commanded sway movement of the marine vessel.

10. The method of claim 9, wherein the sway demand input is a user input at a joystick, and wherein the method further includes, while the sway demand input is continually received from the joystick, automatically controlling the one steerable rear marine drive to alternate between generating the forward thrust at the first steering position and generating the reverse thrust at the second steering position to effectuate the commanded sway movement of the marine vessel.

11. The method of claim 9, wherein the first steering position is a maximum steering position in a first steering direction, and wherein the second steering position is a maximum steering position in a second steering direction opposite the first steering direction.

12. The method of claim 9, wherein the first steering position is in a first steering direction with respect to a centered position and the second steering position is in a second steering direction with respect to the centered position, wherein the second steering direction is opposite the first steering direction.

13. The method of claim 9, further comprising automatically controlling the one steerable marine drive to stop generating any thrust output when the one steerable marine drive is moved between the first steering position and the second steering position.

14. The method of claim 9, wherein the marine propulsion system includes at least one lateral marine drive positioned at a bow region of the marine vessel and configured to generate lateral thrust on the marine vessel, wherein the method further includes controlling the lateral marine drive to generate the lateral thrust based on the sway demand input to generate the commanded sway movement.

15. The method of claim 14, further comprising controlling the lateral marine drive to generate the lateral thrust when the one steerable rear marine drive is generating the forward thrust or the reverse thrust.

16. The method of claim 9, wherein the second predetermined time is longer than the first predetermined time such that the reverse thrust is generated for longer than the forward thrust.

17. The method of claim 9, wherein the first predetermined time and the second predetermined time are the same amount of time.

18. The method of claim 9, further comprising, in response to the sway demand input, automatically controlling the one steerable rear marine drive to generate the forward thrust at the first steering position such that the marine vessel travels a first distance forward, and to generate the reverse thrust at the second steering position such that the marine vessel travels the first distance backward.

19. The method of claim 9, further comprising, in response to the sway demand input, automatically controlling the one steerable rear marine drive to generate the forward thrust at the first steering position such that the marine vessel travels a first speed magnitude in a forward direction, and to generate the reverse thrust at the second steering position such that the marine vessel travels the first speed magnitude in a backward direction.

* * * * *